US005675870A

United States Patent [19]

Cooper

[11] Patent Number: 5,675,870

[45] Date of Patent: Oct. 14, 1997

[54] CABLE TIE

[75] Inventor: William J. Cooper, Woonsocket, R.I.

[73] Assignee: Avery Dennison Corporation, Pasadena, Calif.

[21] Appl. No.: 724,391

[22] Filed: Oct. 1, 1996

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P

[56] References Cited

U.S. PATENT DOCUMENTS

| | | | |
|---|---|---|---|
| 2,979,794 | 4/1961 | De Bartolo | 24/17 AP |
| 3,127,648 | 4/1964 | Emery . | |
| 3,224,056 | 12/1965 | Joffe | 24/16 PB |
| 3,484,905 | 12/1969 | Eberhardt . | |
| 3,590,442 | 7/1971 | Geisinger . | |
| 3,672,003 | 6/1972 | Morgan . | |
| 3,761,999 | 10/1973 | Morgan | 24/16 PB |
| 4,009,509 | 3/1977 | Mccormick . | |

*Primary Examiner*—Victor N. Sakran
*Attorney, Agent, or Firm*—Kriegsman & Kriegsman

[57] ABSTRACT

A one piece cable tie for forming a plurality of objects such as cables into a bundle. The cable tie includes an elongated flexible strap having a top planar surface, a bottom planar surface, a first end and a second end. The strap further includes a plurality of raised teeth spaced along its length. A locking head is integrally formed to the first end of the strap. The locking head includes a top surface, a bottom surface and a strap accepting channel having an entrance end, an exit end, an inner end wall and an outer end wall. A flexible pawl is integrally connected to the outer end wall of the locking head and extends into the strap accepting channel. The flexible pawl is capable of flexion towards the exit end of the strap accepting channel. In use, after the second end of the strap has been inserted through the strap accepting channel and drawn around a bundle and the insertion force is thereafter relaxed, the stored pressure of the bundle by virtue of its configuration pivots the strap causing the flexible pawl to engage with the back surface of one of the teeth to lock the strap in place. While in a pivoted position, the strap may be further advanced through the strap accepting channel.

10 Claims, 3 Drawing Sheets

CABLE TIE

BACKGROUND OF THE INVENTION

The present invention relates to cable ties.

Cable ties, also known as harnessing devices, are well known in the art and are commonly used for bundling objects.

In U.S. Pat. No. 4,009,509 to M. McCormick there is disclosed a cable tie which is moulded in one piece and which comprises an elongate flexible strap provided with ratchet serrations on one side and a head at one end of the strap, the head having an aperture provided with a pivoted pawl having teeth which engage the ratchet serrations of the strap when the free end of the strap is passed through the aperture. The pawl teeth have their crests in a common plane, in the moulded condition of the tie, which lies substantially perpendicular to the plane of the strap. The aperture is formed opposite the pawl with an abutment surface which is inclined to the common plane of the pawl teeth so that the pawl tooth furthest from the pawl pivot is closest to the abutment surface.

In U.S. Pat. No. 3,672,003 to T. E. Morgan there is disclosed a cable tie having an elongated, unitary, flexible strap with an enlarged head at one end. An opening in the head allows the remote strap end to be threaded through the opening in the head to clamp a bundle of wires or the like within the loop so formed. The strap body has an integral flexible pawl extending into the opening to lockingly engage inset ratchet teeth in the strap body adjacent the remote end of the strap.

In U.S. Pat. No. 3,590,442 To G. H. Geisinger there is disclosed a bundling strap for looping about articles, comprised of an elongated, flexible, serrated body integral with and extending from an apertured head and terminating in a tail extension. One end of a dual-ended, obliquely angled, unidirectional locking means is hingedly coupled within a first transverse aperture in the head and is integral therewith, being adapted to lockingly engage the serrations on the elongated body inserted within a second transverse aperture in the head proportioned to conveniently receive the body therein, said locking means thereby preventing the attempted withdrawal of the body from the apertured head.

In U.S. Pat. No. 3,484,905 to R. Eberhardt there is disclosed a flexible tie for a bundle of electrical conductors or the like. The tie is molded in one piece of a resilient, yet generally shape-retaining plastic composition. At one end of the tie is a head having an aperture to admit a strap part extending from the head in order that the device may be looped around the bundle. Within the aperture is a resilient finger having an active edge to engage one of a plurality of teeth on the strap in order that the device may be locked in position around the bundle. The construction is such that more reliable engagement is obtained without the use of metal inserts or other expedients and by means which allows molding of the device in one piece in a simple, inexpensive mold.

In U.S. Pat. No. 3,127,648 to E. F. Emery there is disclosed a binding clip for cables and the like which comprises an elongated flexible tongue, a substantially rectangular frame of a thickness greater than that of said tongue and constituting a head, one end of said tongue being integral with the outer face of one element of said frame, a pawl in said frame, one end of said pawl being integrally connected to the inner face of said one element, said connection constituting a pivot, said pawl extending to about the end of said frame opposite to said one element, the free end of said pawl being tapered, the free end of said pawl being displaceable from within said frame by the passage of the free end of said tongue through said frame between said pawl and said opposite end, said pawl being adapted to return into said frame upon removal of said tongue end from said frame.

SUMMARY OF THE INVENTION

It is an object of this invention to provide a new and improved cable tie.

It is another object of this invention to provide a one-piece cable tie.

It is yet another object of this invention to provide a cable tie as described above which provides for the secure bundling of objects.

It is still another object of this invention to provide a cable tie as described above which has a low profile.

It is another object of this invention to provide a cable tie as described above which includes a flexible pawl.

It is yet another object of this invention to provide a cable tie as described above which has a minimum number of parts, is simple in construction and is easy to use.

Accordingly, there is provided a one piece cable tie for forming a plurality of objects such as cables into a bundle, said cable tie comprising an elongated flexible strap and a locking head, said elongated flexible strap having a top planar surface, a bottom planar surface, a first end and a second end, said elongated flexible strap further including a plurality of raised teeth spaced along its length, each tooth having a back surface, said locking head being integrally formed to the first end of said strap, said locking head having a top surface, a bottom surface and a strap accepting channel, said strap accepting channel having a strap entrance end, a strap exit end, an inner end wall and an outer end wall, said locking head further including a flexible pawl integrally connected to the outer end wall and extending into the strap accepting channel, said flexible pawl being normally in a first position and having an end face, whereby, after said strap has been inserted through said strap accepting channel and drawn around a bundle and the insertion force is thereafter relaxed, the stored pressure of the bundle by virtue of its configuration pivots said strap causing the end face in said flexible pawl to engage the back surface of one of said teeth to lock the strap in place, said flexing movement of said pawl enabling said strap to be further advanced within said strap accepting channel when said strap is in said pivoted position.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 4:
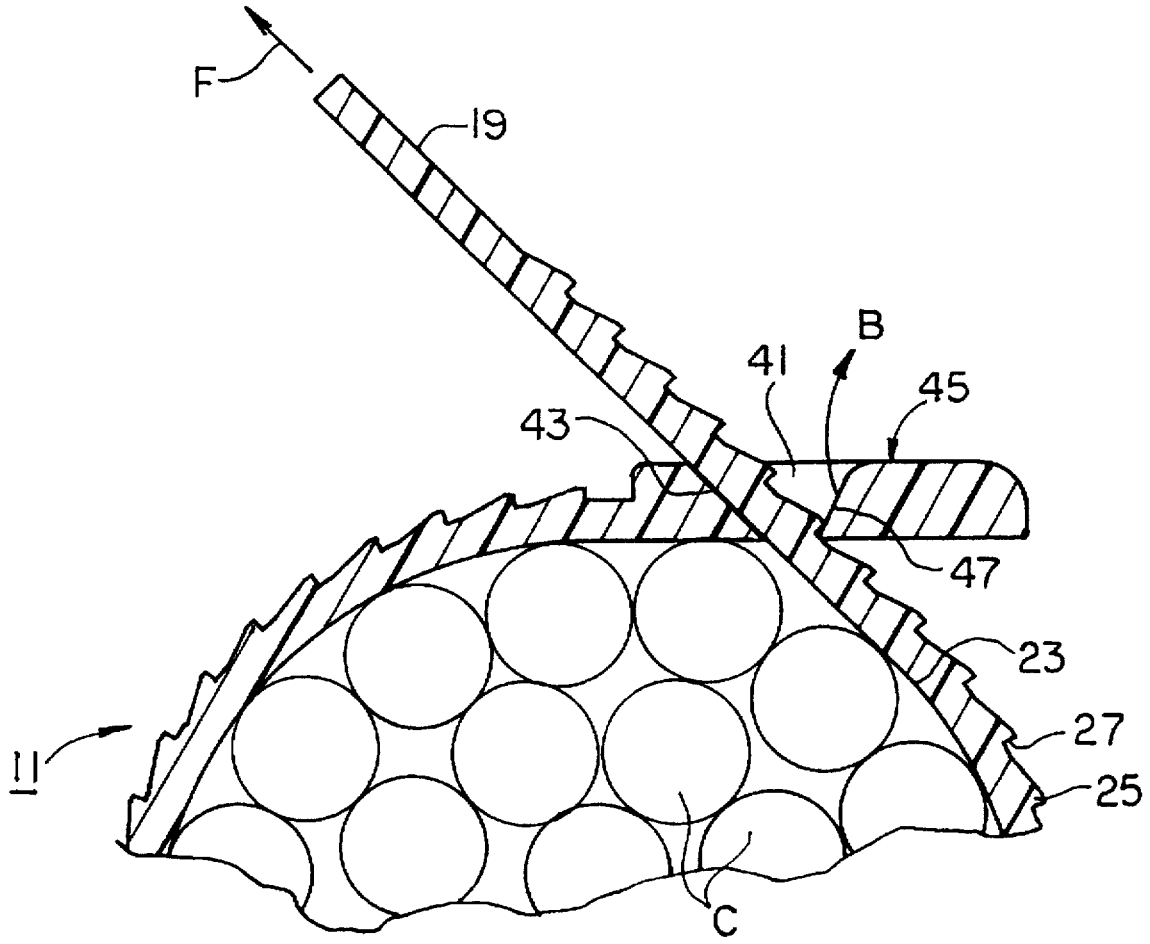
FIG. 4 is a side section view of the cable tie shown in FIG. 1, the tie being shown in the form of a loop wrapped around a bundle of cables.

Referring now to the drawings, there are shown in FIGS. 1–4 a cable tie constructed according to the teachings of the present invention, the cable tie being identified by reference numeral 11. As shown in FIG. 4, cable tie 11 can be used to bundle together a plurality of cables C; however, it is to be understood that the invention is not exclusively limited to bundling cables, but rather may be used to bundle together other objects.

Cable tie 11 is a one piece tie comprising an elongated strap 13 and a locking head 15.

Elongated strap 13 is constructed of a flexible material such as plastic, nylon or a high modulus elastomer and includes a first end 17, a second end 19, a top planar surface 21 and a bottom planar surface 23.

Strap 13 further includes a plurality of teeth 25 spaced along its length. Teeth 25 extend transversely along strap 13 and protrude above top planar surface 21.

Each tooth 25 is ratchet shaped and comprises a rear surface 27 normal to the longitudinal axis A of strap 13, a top flat surface 29 approximately parallel to top surface 21 and a front surface 31 which angles upwardly and rearwardly at an angle of about 45 degrees from the longitudinal axis A of strap 13.

Locking head 15 is integrally formed to first end 17 of elongated strap 13. Locking head 15 comprises a top surface 32-1, a bottom surface 32-2, an outer end wall 33, an inner end wall 35, a first sidewall 37 and a second sidewall 39 which together define a strap accepting channel 41 therebetween. Strap accepting channel 41 includes a strap entrance end 41-1 and a strap exit end 41-2.

Locking head 15 is shaped to include an angled strap resting face 43. Angled strap resting face 43 extends downward and inward from top surface 32-1 of locking head 15 to inner end wall 35 of channel 41 at an angle of approximately 40 degrees. As will be hereinafter explained, a portion of strap 13 rests on top of angled resting face 43 when tie 11 is locked in place around a bundle.

Locking head 15 further includes a flexible pawl 45 integrally connected to locking head 15 and extending into strap accepting channel 41. Flexible pawl 45 is shaped to include a top surface 46, a bevelled end face 47 which tapers downward and into strap accepting channel 41 and a bottom surface 46.

Figure 2:
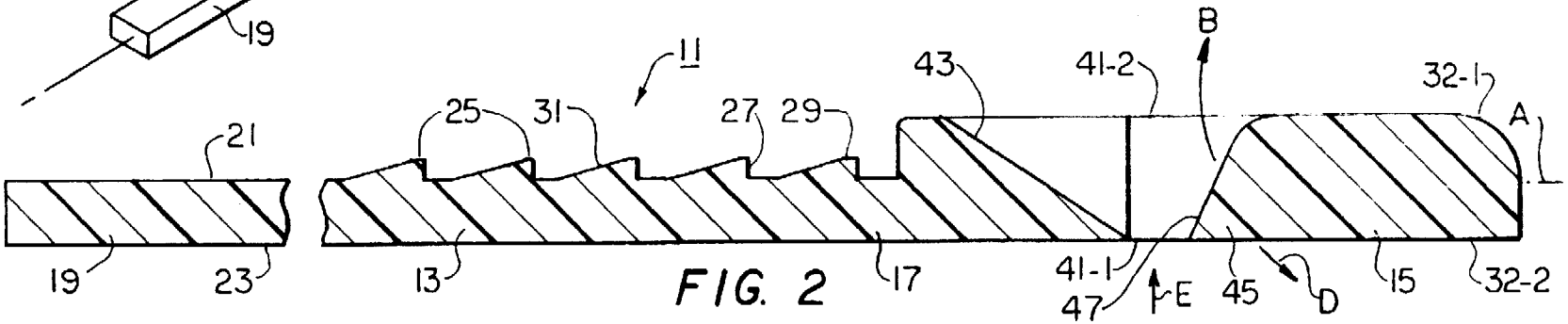
FIG. 2 is a side section view of the cable tie shown in FIG. 1.
Figure 3:
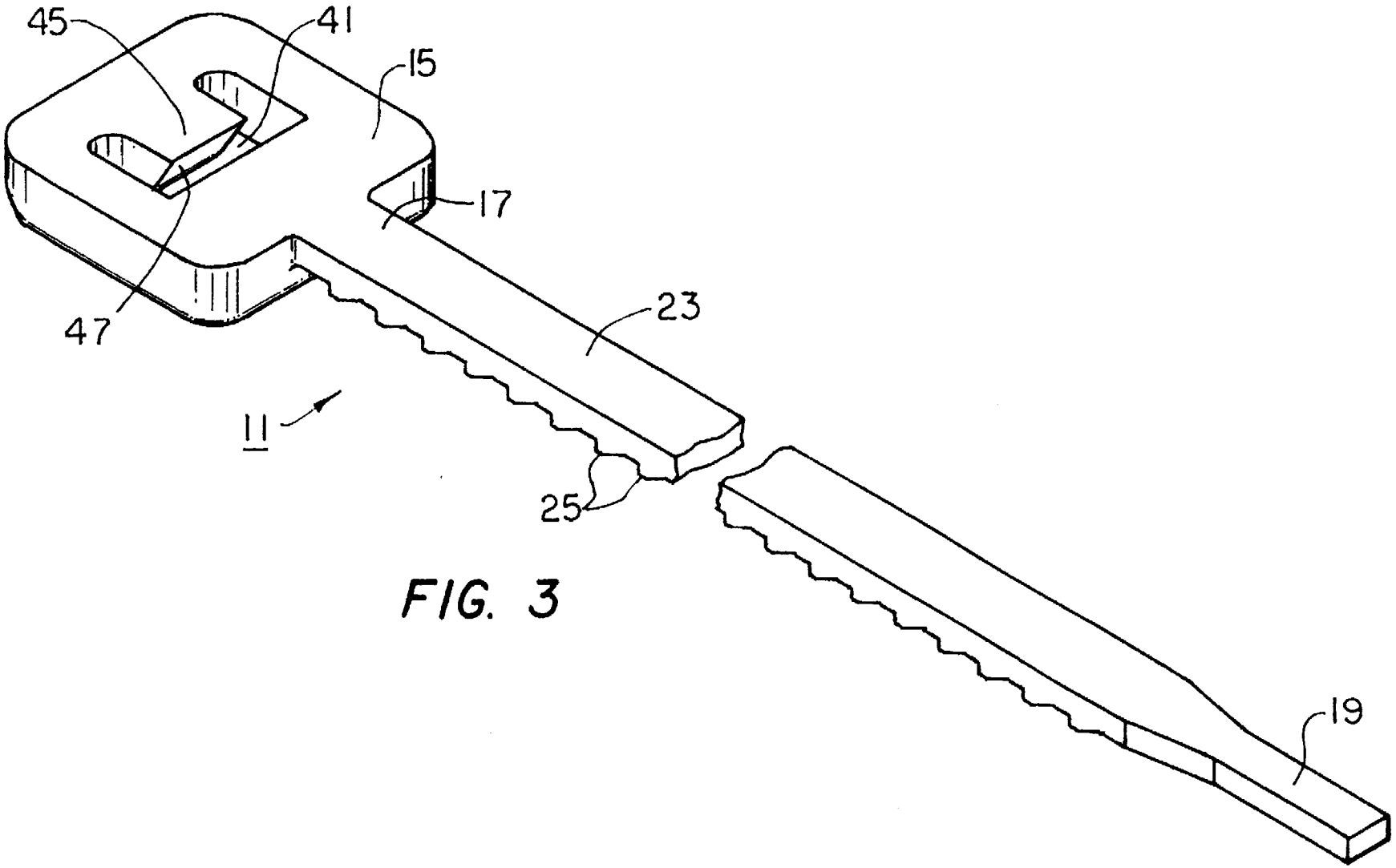
FIG. 3 is a perspective view taken from the bottom of the cable tie shown in FIG. 1.

In its normal position, as shown in FIG. 2, flexible pawl 45 extends into strap accepting channel 41 so as to partially restrict passage of strap 13 through strap accepting channel 41 to the area between pawl 45 and face 43. However, due to its construction, pawl 45 is capable of flexion upwards above surface 32-1 in the direction shown by arrow B in FIG. 2 but is incapable of flexion downward below surface 32-2 in the opposite direction as shown by arrow D; therefore, as will become apparent, strap 13 is incapable of being pulled out from strap accepting channel 41 in through strap entrance end 41-1.

Figure 1:
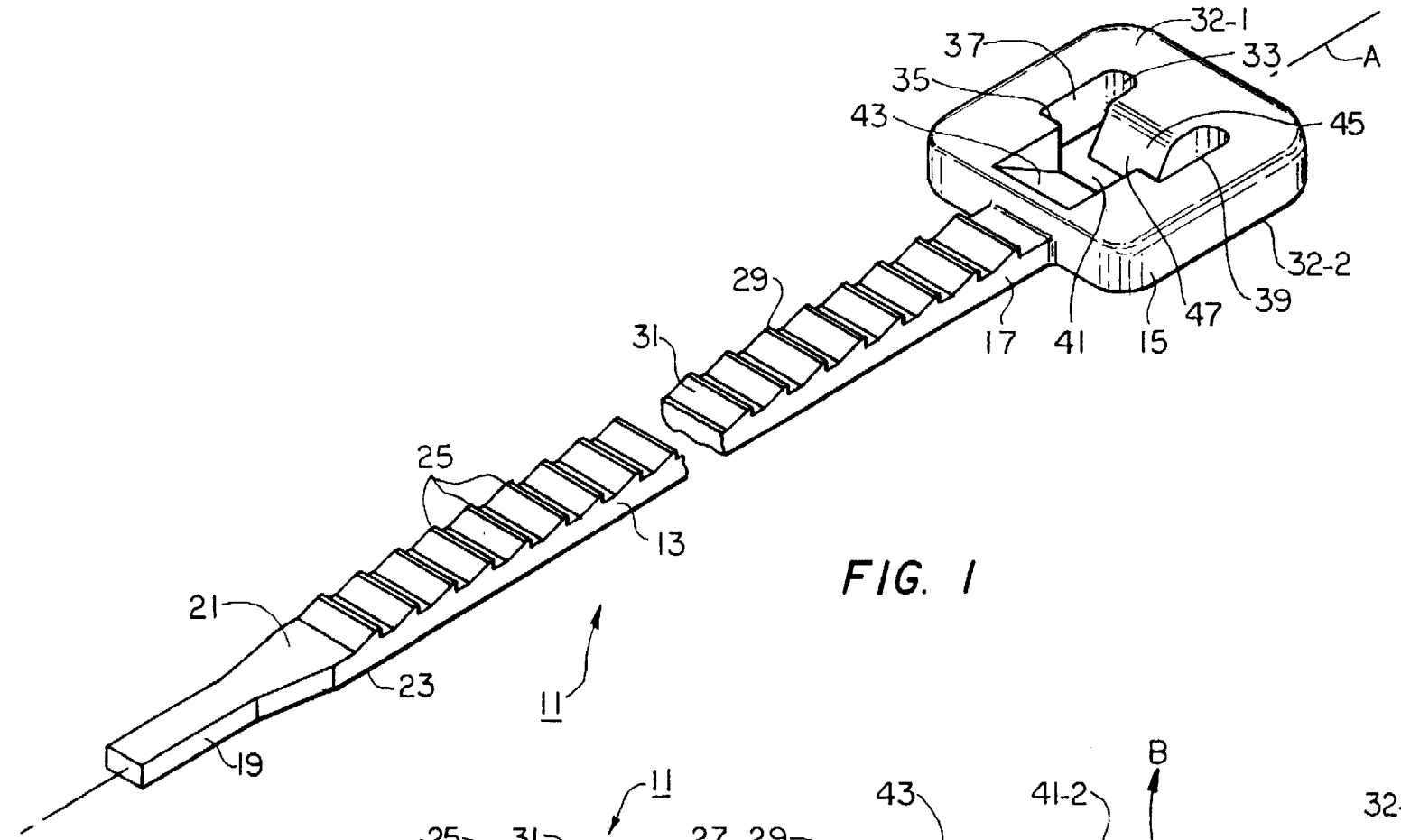
FIG. 1 is a perspective view taken from the top of a first embodiment of a cable tie constructed according to the teachings of the present invention.

Tie 11 may be used to secure a plurality of cables C as a bundle in the following manner, as shown in FIG. 4. Second end 19 of strap 13 is wrapped around cables C and is inserted through strap accepting channel 41 in the direction shown by arrow E in FIG. 2 to form a loop. Strap 13 is further advanced through strap accepting channel 41 to reduce the size of the loop, drawing tie 11 around the bundle of cables C. As strap 13 is moved relative to locking head 15, pawl 45 is rotated up in the direction of arrow B to index from tooth to tooth. Once a tooth passes by pawl 45, pawl 45 will return to its normal position, as shown in FIG. 1. As the insertion force on strap 13 is relaxed, the stored pressure of the bundle by virtue of its configuration pushes against bottom surface 23 causing strap 13 to pivot. As strap 13 pivots, rear surface 27 of one of teeth 25 abuts against bevelled end face 47 of flexible pawl 45 to lock tie 11 in place around the bundle. Locked in this position, a portion of bottom surface 23 will lie on top of angled resting face 43. Because pawl 45 is flexible in an upward direction toward strap exit 41-2, strap 13 can be further advanced (tightened) in head 15 even when strap 13 is in a pivoted position, as shown by arrow F in FIG. 4.

As can be seen in the Figures, tie 11 is a low profile tie in that top surface 32-1 of head 15 does not project above top flat surface 29 of cross-member 25 and bottom surface 32-2 of head 15 does not project below surface 23 of strap 13. In fact, top surface 32-1 is coplanar with top flat surface 29 of cross-members 25 and bottom surface 32-2 is coplanar with bottom surface 23.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A one piece cable tie for forming a plurality of objects such as cables into a bundle, said cable tie comprising:

(a). an elongated flexible strap having a top planar surface, a bottom planar surface, a first end and a second end, said strap having a plurality of raised teeth spaced along its length, each tooth having a back surface, (b). a locking head integrally formed to the first end of said strap, said locking head having a top surface and a bottom surface and including a strap accepting channel having a strap entrance end, a strap exit end, an inner end wall and an outer end wall, and (c). a flexible pawl integrally connected to the outer end wall and extending into the strap accepting channel, said flexible pawl having an end face, said flexible pawl being constructed to be normally in a first position and capable of flexion to a second position, (d). whereby after the second end of said strap has been inserted through said strap accepting channel and the strap is drawn around a bundle and the insertion force is then thereafter relaxed, the stored pressure of the bundle by virtue of its configuration will pivot said strap causing said end face in said flexible pawl to engage the back surface of one of the teeth to lock the strap in place, said flexible pawl being capable of flexion from the first position to the second position when the second end of said strap is in its pivoted position to enable the strap to be further inserted through the strap accepting channel, said flexible pawl returning to the first position as the insertion force is relaxed.

2. The cable tie as claimed in claim 1 wherein during insertion of the second end of said strap through the strap accepting channel, said pawl flexes from the first position to the second position and back to the first position as said pawl indexes from tooth to tooth.

3. The cable tie as claimed in claim 2 wherein the inner end wall of said strap receiving channel is shaped to include an angled resting face on which a portion of said strap rests when said strap is pivoted and said flexible pawl is in the first position, wherein the angled resting face slopes downwardly and inwardly.

4. The cable tie as claimed in claim 3 wherein said end face in said pawl is bevelled.

5. The cable tie as claimed in claim 4 wherein said flexible pawl is shaped so as to flex towards said exit face.

6. The cable tie as claimed in claim 5 wherein said teeth project up from the top planar surface of said strap.

7. The cable tie as claimed in claim 6 wherein said teeth are ratchet shaped.

8. The cable tie as claimed in claim 7 wherein said teeth include an angled front face.

9. The cable tie as claimed in claim 8 wherein said pawl further includes a top surface and a bottom surface.

10. The cable tie as claimed in claim 9 wherein said end face extends downwardly and inwardly.

* * * * *